US005573122A

United States Patent [19]

Williams

[11] Patent Number: 5,573,122

[45] Date of Patent: Nov. 12, 1996

[54] GOLF CLUB ORGANIZER ASSEMBLY

[76] Inventor: Ron Williams, 506 E. Happy Valley St., Cave City, Ky. 42127

[21] Appl. No.: 313,876

[22] Filed: Sep. 28, 1994

[51] Int. Cl.[6] ..... A63B 55/00

[52] U.S. Cl. ..... 211/70.2; 211/14; 211/15; 248/96; 206/315.6

[58] Field of Search ..... 211/70.2, 14, 15; 206/315.2, 315.3, 315.4, 315.6, 315.5; 248/96

[56] References Cited

U.S. PATENT DOCUMENTS

| | | | |
|---|---|---|---|
| 3,966,051 | 6/1976 | Hollister | 211/14 |
| 4,172,484 | 10/1979 | Henning | 248/96 |
| 4,420,024 | 12/1983 | Clayton | 206/315.4 |
| 4,522,299 | 6/1985 | Clark et al. | 248/96 |
| 4,834,444 | 5/1989 | Young | 294/143 |
| 4,852,896 | 8/1989 | Mills | 211/70.2 |
| 5,102,529 | 4/1992 | Hickin | 206/315.3 |
| 5,135,107 | 8/1992 | Ingraham | 211/70.2 |
| 5,188,243 | 2/1993 | Ruiz | 211/70.2 |

FOREIGN PATENT DOCUMENTS

| | | | |
|---|---|---|---|
| 2134797 | 8/1984 | United Kingdom | 248/96 |

*Primary Examiner*—Ramon O. Ramirez
*Assistant Examiner*—Willie W. Berry, Jr.

[57] ABSTRACT

A rigid golf club organizer assembly adapted for being carried individually or in pairs on the rear deck of a golf cart for carrying irons and wedges in a logical sequence and for carrying woods separate and apart from the irons and wedges is disclosed. In the illustrated example, the assembly includes five hollow tubes disposed next to one another in a first row and five additional hollow tubes disposed next to one another in a second row. The first and second rows of tubes are disposed at a right angle to one another and meet at an apex. Each of the tubes in both contain a notched upper end for holding the head of an iron or wedge therein and each tube is of a different height than all of the other tubes in the two rows and is adapted to loosely confine the shaft of a different iron or wedge of a golf club set therein. The two rows of tubes are reinforced by a pair of rectangularly shaped reinforcing members. A series of at least three woods can be carried in the reinforcing members behind the tubes which carry the irons and wedges. Additional features include a golf ball dispenser, putter holding tube, umbrella holding tube and a pin for holding a hand towel.

12 Claims, 4 Drawing Sheets

GOLF CLUB ORGANIZER ASSEMBLY

BACKGROUND OF THE INVENTION

This invention relates generally to an assembly for storing golf clubs in a logical sequence for ready access. More specifically, this invention relates to a relatively rigid assembly for removable mounting on the rear deck of a golf cart in place of a conventional golf bag for storing irons and wedges in a logical sequence and for storing woods and a putter separate and apart from the sequenced irons and wedges.

Broadly speaking, numerous arrangements for storing and separating golf clubs on the backs of golf carts in place of the ordinary golf bag have been known in the prior art. Two such arrangements for use with golf carts are disclosed in U.S. Pat. No. 5,213,364 issued to K. L. Theckston on May 25, 1993 and U.S. Pat. No. 5,069,481 issued to W. M. Strange on Dec. 3, 1991. Both of these arrangements provide a plurality of tubes or holders for carrying different golf clubs of a set therein for access from the rear of a golf cart. However, in both cases, substantial modification of a conventional golf cart is required. Moreover, once these arrangements are installed on a golf cart, they are not easily broken down to remove them for use of the cart to carry conventional golf bags. The Theckston arrangement, in particular, is a complex assembly which, when installed, is clearly intended as a permanent installation.

There are, however, numerous other golf club holders of a portable variety that can be readily removably strapped to the back of a conventional golf cart without modification which are known in the prior art. Some of these employ a plurality of elongated hollow tubes, each of which is adapted to hold a single club. See, for example, U.S. Pat. No. 5,188,243 issued to C. D. Ruiz on Feb. 23, 1993; U.S. Pat. No. 5,135,107 issued to C. R. Ingraham on Aug. 4, 1992; U.S. Pat. No. 4,420,024 issued to C. R. Clayton on Dec. 13, 1983. One difficulty encountered with these assemblies is that irons and wedges are not stored separate and apart from woods, whereby the relatively larger heads of the woods can conceal some or all of the irons and wedges from view so as to make selecting a specific iron or wedge difficult and, often, time consuming. While the Ingraham assembly contains four hollow tubes in a golf bag which have plugs therein at different depths for holding four woods whose heads are at different heights above the upper rims of the tubes so as not to interfere with each other or with irons stored in notched tubes in the bag, there is no provision for a logical sequence of arrangement for irons and wedges therein. Also, since the plugs in the four tubes are concealed from view, the relative lengths of each of these tubes is not readily ascertainable in the event a user desires to store irons having different length shafts therein, although, since these four tubes are not notched, they are not adapted for storage of irons or wedges therein in any case.

Other portable golf club carriers containing tubes for holding the shafts of different golf clubs of a set therein are exemplified in U.S. Pat. No. 3,966,015 issued to R. O. Hollister, et al. on Jun. 29, 1976; U.S. Pat. No. 5,102,529 issued to R. Hickin on Apr. 7, 1992; and U.S. Pat. No. 4,834,444 issued to M. R. Young on May 30, 1989. These carriers each contain one or more stakes on the bases thereof which can be driven in the ground to make such carriers free standing. While this is convenient for use of such assemblies on and about fairways and greens of golf courses, these units are not adapted for being carried in an upright position on the back of a golf cart in the same manner as the usual golf bag. In any event, these prior art carriers make no provision for storing irons and wedges in a logical sequence for ease of access.

By means of my invention, these and other difficulties encountered using prior art golf club storing assemblies are substantially overcome.

SUMMARY OF THE INVENTION

It is an object of my invention to provide a golf club organizer assembly for use on the rear deck of a conventional golf cart in place of a conventional golf bag.

It is another object of my invention to provide a golf club organizer assembly of relatively rigid construction as compared to a conventional golf club bag.

It is yet another object of my invention to provide a golf club organizer assembly which is adapted to readily maintain irons and wedges in a logical placement relative to one another for ease of access and storage of individually selected ones of such clubs.

It is also an object of my invention to provide a golf club organizer assembly which provides for storage and access of and to woods and a putter separate and apart from the storage and access of and to irons and wedges such that the latter types of clubs are not concealed by the former.

Briefly, in accordance with my invention there is provided a golf club organizer which includes a first plurality of elongated, hollow tubes disposed next to and extending parallel with one another to form a first row of such first tubes. Also included is a second plurality of elongated, hollow tubes disposed next to and extending parallel with one another to form a second row of such second tubes. Each of the first and second pluralities of tubes are of a different length from that of all of the other of such first and second pluralities of tubes and contain an interior sized to loosely confine the shaft of a specific one of a set of golf clubs therein, which set is selected from the group consisting of irons and wedges. The first and second rows of such tubes are disposed at an angle relative to one another and meet at an apex, all of the lower ends of such tubes being situated in a single plane for disposition upon a flat supporting surface. Also included is reinforcing means attached to such tubes for maintaining the disposition of such tubes relative to one another.

These and other objects, features and advantages of my invention will become apparent to those skilled in the art from a study of the following detailed description and attached drawings upon which, by way of example, only a preferred embodiment of my invention is explained and illustrated.

DESCRIPTION OF THE PREFERRED EMBODIMENT

Figure 1:
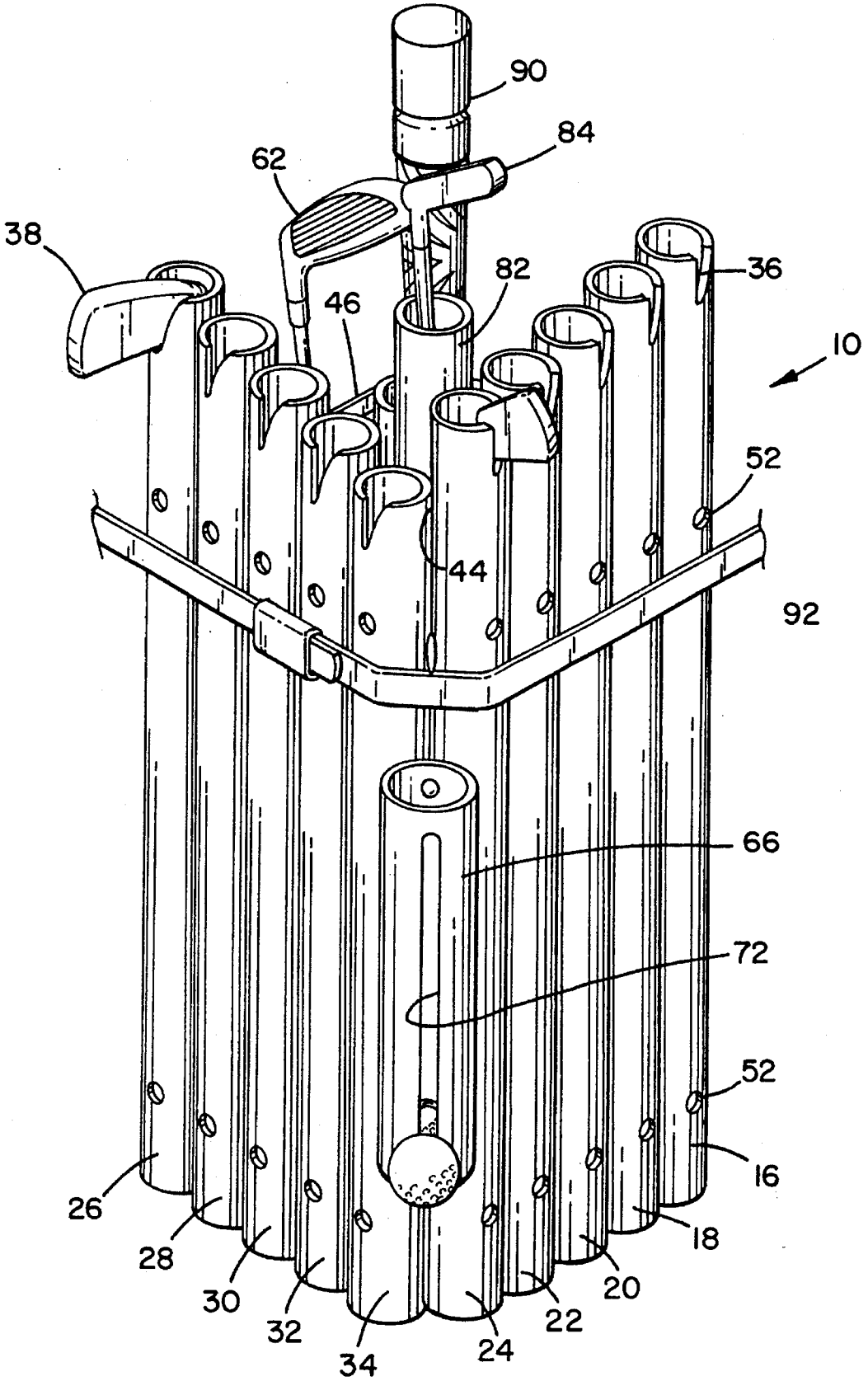
FIG. 1 shows a generally frontal perspective view of a golf club organizer, thus illustrating a preferred embodiment of my invention.
Figure 2:
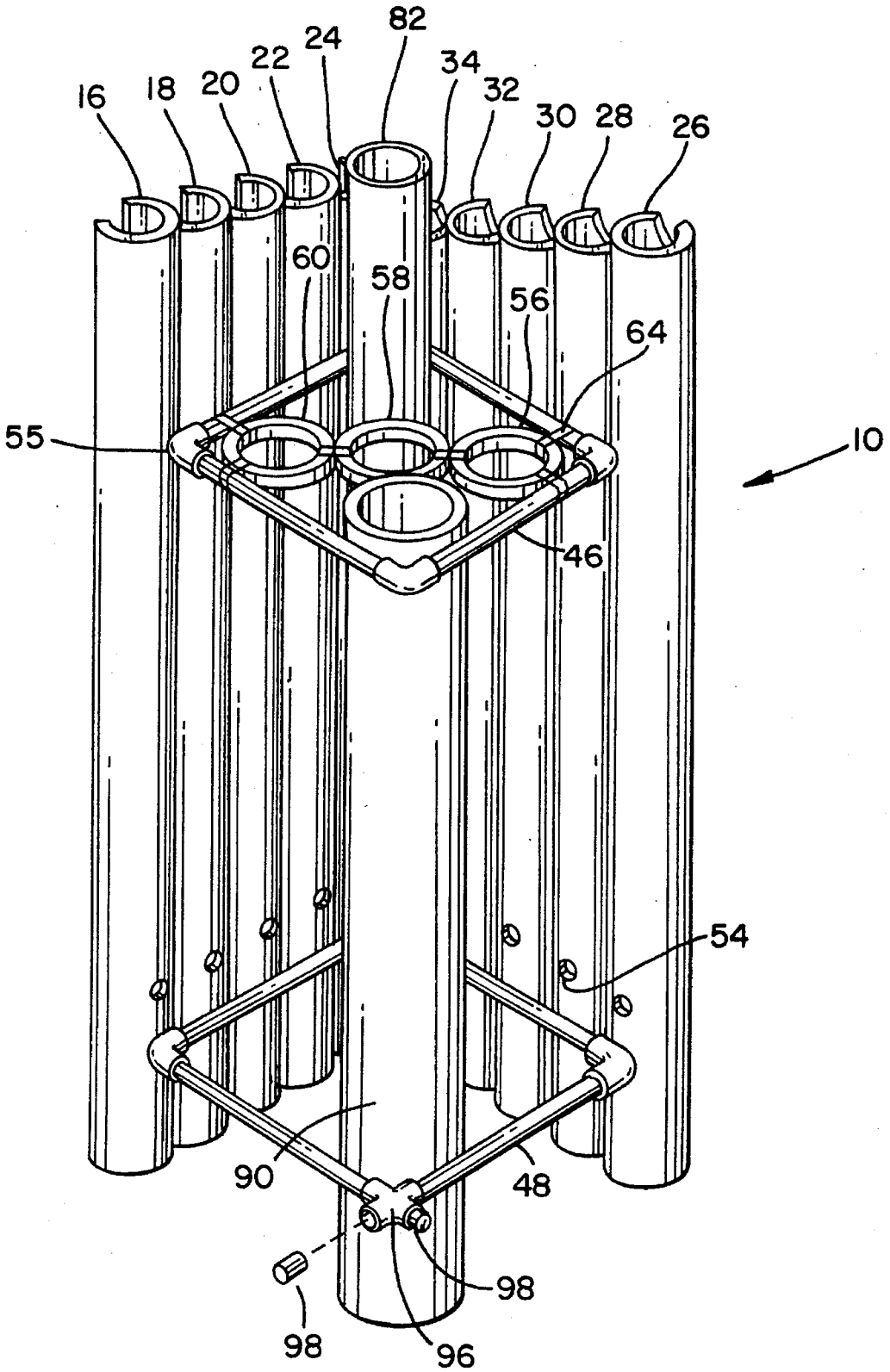
FIG. 2 shows a rear perspective view of the organizer of FIG. 1.
Figure 3:
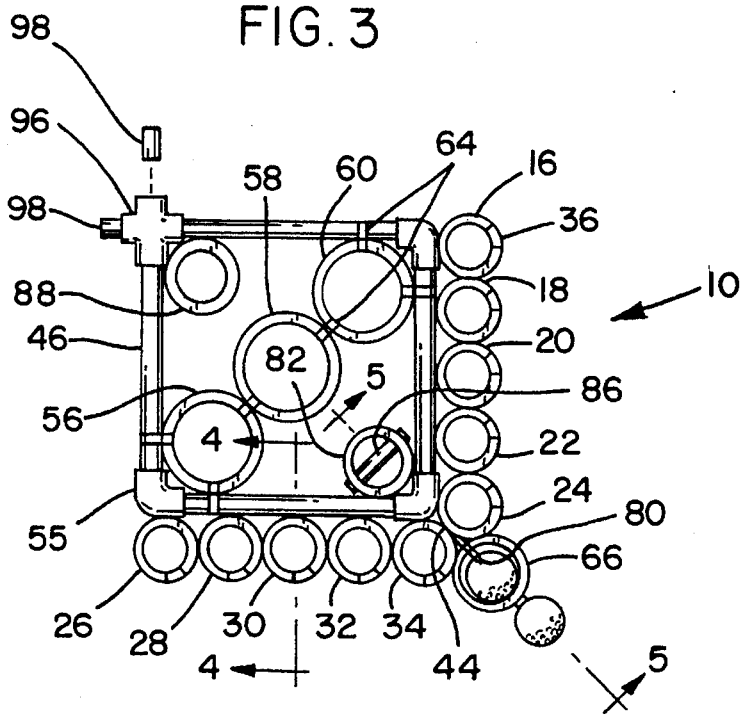
FIG. 3 shows a plan view of the organizer of FIGS. 1–2.
Figure 4:
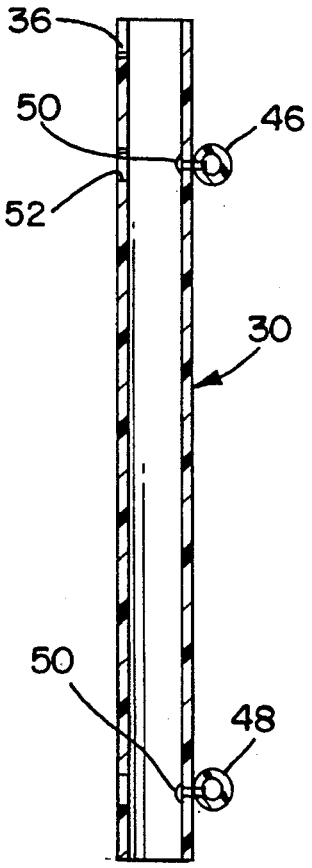
FIG. 4 shows a cross-sectional view of a portion of the organizer of FIGS. 1–3 as viewed along cross-section lines 4—4 of the latter mentioned figure.
Figure 5:
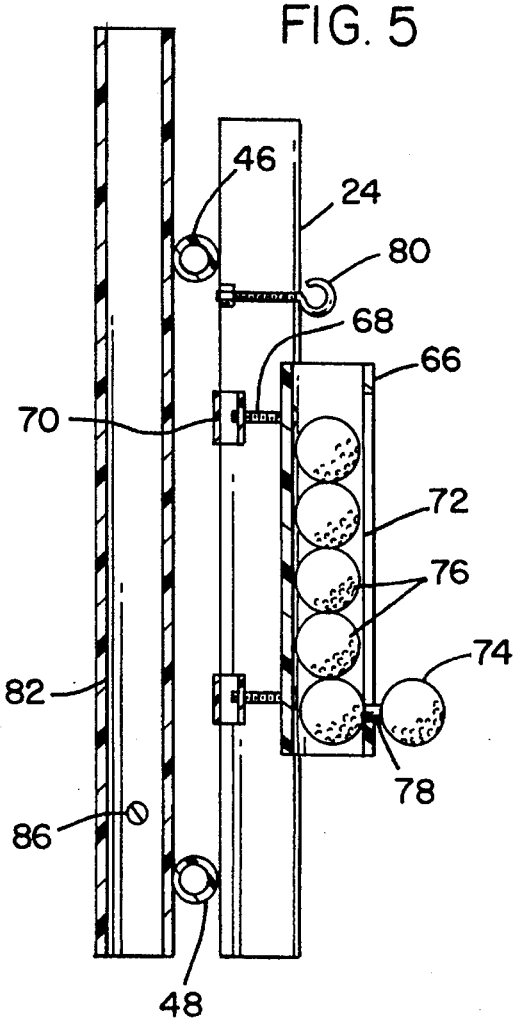
FIG. 5 shows a cross-sectional view of a portion of the organizer of FIGS. 1–3 as viewed along cross-section lines 5—5 of the latter mentioned figure.
Figure 6:
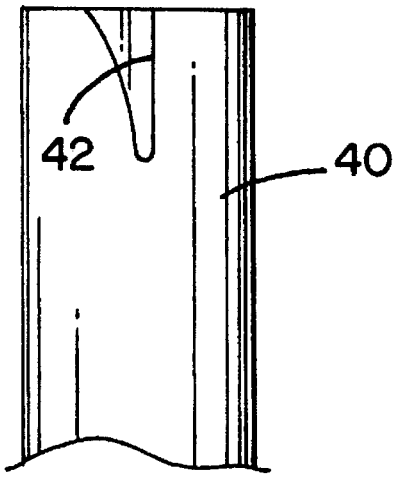
FIG. 6 shows an elevation view of an upper end portion of a single golf club holder similar to those shown in FIGS. 1–5 except that the holder of this view is notched for holding a left hand rather than a right hand golf club.
Figure 7:
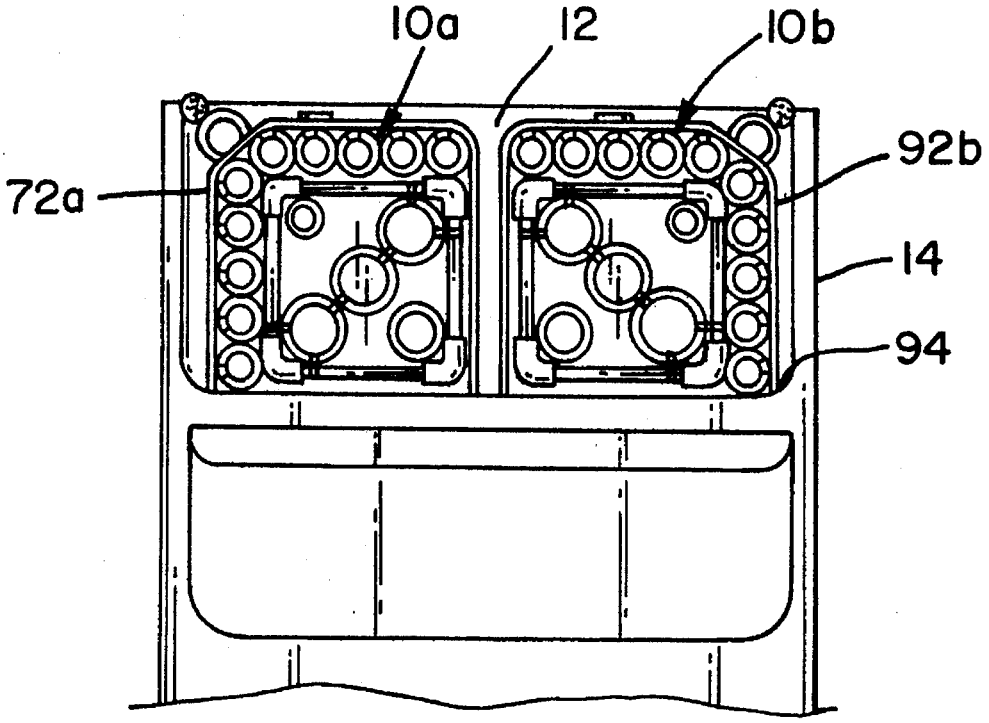
FIG. 7 shows a plan view of a pair of organizers similar to the organizer of FIGS. 1–3 as mounted on the rear deck of a conventional golf cart.

Referring now to the drawing figures and, in particular, to FIGS. 1–5 and 7 there is shown, in a preferred embodiment of my invention, a novel golf club organizer, generally designated 10. The organizer 10 is a rigid assembly that is particularly adapted for mounting in pairs, generally designated 10*a* and 10*b*, on the rear deck 12 of a conventional golf cart 14 as shown in FIG. 7 and as later more fully explained. The organizer 10 is characterized by a first plurality of elongated, hollow, open ended tubes 16, 18, 20, 22 and 24 which are aligned next to one another to form a first row and a second plurality of such tubes 26, 28, 30, 32 and 34 which are aligned next to one another to form a second row. The two rows of tubes are vertically extending when in an operative, golf club carrying disposition and each tube has its own unique length different from that of all of the other tubes in both rows, such that each of the tubes is adapted to hold the shaft of a golf club of specific maximum length. Each of the tubes 16–34 in these two rows contain a notch 36 in an upper end portion thereof which, in the embodiment of FIGS. 1–3, is adapted to confine and protect the head of an iron or wedge 38 of the type used by a right handed golfer. The tubes 16–34 protect the shafts of the irons and wedges 38. FIG. 6 shows an upper end portion of a tube 40, similar to the tubes 16–34 of FIGS. 1–3 in all respects, except that it contains a notch 42 in an upper end portion thereof which is adapted for confining the head of an iron or wedge of the type used by a left handed golfer. Thus, the organizer of my invention can be constructed to accommodate the irons and wedges of either a right or a left handed golfer as desired.

Referring again to FIGS. 1–5 and 7, the first row of tubes 16–24 and the second row of tubes 26–34 are preferably disposed at a right angle to one another as best seen in FIG. 3 and both rows meet at an apex 44 (See FIGS. 1 and 3). A pair of vertically spaced apart, rectangularly shaped reinforcing elements 46 and 48 which lie in parallel planes and which are perpendicular to the longitudinal axes of the tubes 26–34 are attached to the tubes 26–34 by wood or deck screws 50 (See FIG. 4). A hole 52 is bored through the front facing surface of each of the tubes 26–34 at the levels that the reinforcing members 46 and 48 are to be placed behind the tubes 26–34 to permit the screws 50 to be inserted between the rearwardly facing surface of each of the latter and the reinforcing members 46 and 48. The holes 52 may then be covered with decals of suitable design or with other coverings if desired. The bottom ends of the tubes 26–34 are aligned to sit flush on a flat supporting surface such as the golf cart deck 12 of FIG. 7 as previously mentioned. If the holes 52 in the lower frontally exposed surfaces of the tubes 16–34 are covered, then additional holes 54 should be bored in the rearwardly facing surfaces of those tubes near their lower ends as shown in FIG. 2 and left uncovered to provide means for moisture or water vapor to escape from the tubes which will otherwise tend to collect therein during high humidity conditions when the handles of moisture laded golf club shafts are disposed therein.

I recommend forming the tubes 16–34 out of 1¼ inch inside diameter cylindrical PVC pipe and forming the reinforcing members 46 and 48 out of four ½ inch diameter PVC pipes, each of which is 6 inches long with four ½ inch PVC elbows 55 used to join the members in a square configuration. I also recommend the length of the tubes 16–34 be, in that order, 41, 40½, 40, 39½ and 39 inches in the first row, respectively, and 38½, 38, 37½, 37 and 36½ inches in the second row, respectively. Thus, the first row of the tubes 16–24 will hold an eight iron, nine iron, pitching wedge, lob wedge and sand wedge, respectively, while the second row of tubes 26–34 will hold a three iron, four iron, five iron, six iron and seven iron respectively. To match the proper tube with the correct iron or wedge it, is simply necessary to hold the iron or wedge in an inverted vertical alignment in front of the tubes 16–34 and find the shortest one of the tubes in which a given iron or wedge will fit such that the top of the club shaft does not touch the supporting surface 32 at the base of the tube when the club head is inserted fully into the corresponding notch 36. In the alternative, the number of a particular iron or identification of a particular wedge can be painted, stamped or otherwise affixed to the particular tube which it is intended to hold.

Additional features of the organizer 10 of my invention include three rings 56, 58 and 60 (FIGS. 2–3) which are preferably of 2 inch inside diameter which serve as holders for three woods 62, only one of which is shown in FIG. 1. The rings 56, 58 and 60 are suspended in a line between opposite corners of the upper reinforcing member 46 and are secured to one another and to the member 46 by means of plastic coated wires, tie bands 64 or other suitable means. The rings 56, 58 and 60 may be wrapped in a suitable foil or fabric to cover any sharp edges of the PVC pipe that has been cut to form them. Thus, the organizer 10 not only maintains the irons and wedges 38 in a logical sequence for ease of access, it also maintains the woods 62 separate from the irons and wedges 38 so as not to hide the latter clubs from view when needed, as is a problem often encountered when using an ordinary golf bag.

At the front of the organizer 10, at the apex 44, there is disposed a golf ball dispenser tube 66. The dispenser 66 may be constructed of PVC pipe and may be of any convenient length and of an inside diameter sufficient to hold a single column of golf balls. I recommend making the dispenser out of 2 inch inside diameter PVC pipe about 20 inches in length. As shown in FIG. 5, the dispenser 66 is secured through the apex 44 by suitable fasteners 68 which connect to short pieces of PVC pipe 70 on the back side of the assembly 10. In the front wall of the dispenser 66 is a vertically extending slit 72 (See FIGS. 1 and 5) of about ¼ inch width in which a handle 74 can be lifted to lift golf balls 76 out of the open top thereof, one at a time. The handle 74 of the present example is a pair of golf balls, one located in the interior of the dispenser tube 66 and the other located external to the tube with the two golf balls being joined by a four inch long 3/16 inch dowel pen 78 which passes through the slit 72. In such an arrangement the outer golf ball can be raised by hand to raise the attached golf ball in the interior of the tube 66 to, in turn, raise a column of golf balls 76 until an uppermost one of the balls 76 pops out of the upper open end of the tube 66 into the users hand. Upon release of the handle, the latter will simply fall back to the lower end of the slit 72 near the bottom of the dispenser 66.

Another feature of the organizer 10 of this example is an eye hook 80 inserted in the apex 44 above the upper end of the golf ball dispenser tube 66 so as to leave sufficient clearance above the latter to dispense the balls 76. The hook 80 serves to hold a cloth or towel for wiping the hands. Another feature of the organizer 10 is a tube 82 for holding a putter 84 (See FIG. 1) which is preferably located at a front corner inside the reinforcing members 46 and 48 in line with the apex 44. The putter tube 82 may also be constructed of cylindrically shaped, open ended PVC pipe. I recommend using a pipe for this purpose which is 1¼ inches in inside diameter and 36 inches long. Unlike the case of the tubes 16–34, however I prefer to position the lower end of the tube 82 about 4–6 inches above the base of the organizer 10. But unlike the case with the tubes 16–34, the putter tube 82 contains means for supporting the upper end of the shaft of the putter 84 when the shaft is inserted therein such that the head of the putter 84 is elevated above the upper rim of the tube as shown in FIG. 1. In the present example, such supporting means is a dowel pen 86 as seen in FIG. 3. Since the head of the putter 84 is spaced above the upper rim of the tube 82 when the shaft is inserted therein so as to rest on the pen 86, the tube 82 will not require a notch such as at 36 in each of the tubes 16–34.

Another additional feature of the organizer 10 of my invention is a holder tube 88 for an umbrella 90 (See FIGS. 1–3). The tube 88 may be constructed of cylindrically shaped PVC pipe and is preferably 2 inches in inside diameter by 34 inches long. The tube 88 is disposed at the inside of the rear corner of the reinforcing member 46 in line with the apex 44 such that the lower open end thereof sits flush on the flat supporting surface 12. An advantage I have discovered using the organizer 10 of this example is that, when it rains, the user can retrieve the umbrella 90 from its holding tube 88, open it, remove the putter 84 from its holding tube 82 and place it in the umbrella holder 90 while inserting the handle of the open umbrella 90 in the putter holding tube 82 to thus cover the entire assembly 10. Otherwise, however, when the weather is clear, it is advantageous having the putter 62 disposed in the holding tube 82 at the front of the assembly 10 immediately behind the apex 44 of the two rows of tubes 16–34 since the putter 84 is one club that will be used at virtually every hole of a golf course, barring, of course, an occasional and extremely fortunate shot to a pin from somewhere off the corresponding putting green when using another type of club.

The organizer 10 is constructed so that two such assemblies 10*a* and 10*b* as shown in FIG. 7 can be mounted on the rear deck 12 of the golf cart 14 and secured to the back of the golf cart seat by a pair of straps 92*a* and 92*b* respectively (See also strap 92 in FIG. 1) of conventional type which are ordinarily used to secure conventional golf bags in that position. On some popular models of golf carts such as the cart 14 of FIG. 7, the back deck 12 contains two rounded rear corners 94 which are rounded on a relatively large radius. As a result, when the organizers 10*a* and 10*b* are disposed toward the rear of the deck 12, the outside rear edges of the assemblies 10*a* and 10*b* tend to rest in and against these radii such that the opposing inside rear corners of the assemblies 10*a* and 10*b* will tend to twist inwardly under the influence of the straps 92*a* and 92*b*, particularly as a result of vibration of the golf cart 14 when in motion. To avoid such twisting movement, I substitute a conventional four way or cross-shaped PVC connector 96 in place of one of the elbows 55 of the lower reinforcing member 48 so as to locate it at the rear of the organizer 10 along an imaginary diagonal line through the apex 44 (See FIGS. 2–3). The cross member 96 performs the same function as the elbows 55 but, in addition, permits a short piece of PVC tubing to be frictionally and removably inserted therein to form a stop member 98. The stop member 98 should be of such a length when securely inserted in the cross member 96 as to project rearwardly against the back vertical wall of the deck 14 when the outside corner of the corresponding assembly 10*a* or 10*b* is flush against the radial portion of the wall. In this way, when the straps 92*a* and 92*b* are drawn tight and secured about the organizers 10*a* and 10*b*, the latter will be restrained by the rearwardly projecting stop members 98 from twisting on the deck 14. Since the stop member 98 is removable, it can be interchanged between two positions in the cross member 96 depending on which side of the rear deck 12 a given one of the assemblies 10*a* or 10*b* is placed, as indicated best in FIGS. 2–3 wherein a first stop member 98 is shown inserted in the cross member 96 and a second is shown exploded from the cross member 96 at a right angle from the first. Those skilled in the art will appreciate that the number of iron and wedge tubes to be used in the organizer 10 is a matter of choice, although I prefer to use the ten tubes 16–34 as shown in the present example together with three rings 56–60 for the woods 62 to provide for full complement of clubs in accordance with standard golfing practices. As an alternative to the present example, I have also constructed an organizer similar to the organizer 10 except that I have substituted two vertically spaced apart triangularly shaped reinforcing members in place of the rectangularly shaped members 46 and 48. In this alternative arrangement, I have simply placed three woods within the two triangularly shaped reinforcing members without using the rings 56, 58 and 60. The putter holding tube 82 occupies the same position in this arrangement as it does when using the rectangular members 46 and 48 and the umbrella holder 88 is placed at either one of the two remaining corners. A difficulty encountered with this arrangement is that the organizer will tend to be twisted horizontally on the mounting surface 12 when mounted in pairs on the type of cart which has a rear deck with widely rounded rear corners as is the case with the cart 14 of the illustrated example.

While the present invention has been explained and illustrated with respect to specific details of a preferred embodiment thereof it is not intended that such details limit the scope and coverage of this patent other than as specifically set forth in the following claims.

I claim:

1. A golf club organizer for removable mounting on a rear deck of a conventional golf cart comprising a first plurality of elongated, hollow tubes disposed next to and extending parallel with one another to form a first row of said first tubes, a second plurality of elongated, hollow tubes disposed next to and extending parallel with one another to form a second row of said second tubes, each of said first and second tubes being of a different length from that of all of the other of said first and second tubes and having an interior sized to loosely confine the shaft of a golf club therein, each of said tubes defining a notch in an upper end portion thereof for confining the head of a golf club therein, which golf club head is selected from the group consisting of irons and wedges, one end of said first row being disposed next to one end of said second row to form an apex of an angle between said first and said second row, a base of each of said tubes lying in a single plane for mounting on a flat supporting surface, and reinforcing means attached to each of said tubes for maintaining the disposition of each of said tubes relative to one another in said first and said second row, said reinforcing means comprising a closed sided structure having a plurality of sides forming a plurality of interior angles and an open area enclosed by said sides, said first row and said second row being aligned against two adjacent sides of said reinforcing means outside of said open area.

2. The organizer of claim 1 wherein said reinforcing means is also adapted to loosely confine the shafts of at least three golf club woods therein.

3. The organizer of claim 1 wherein said reinforcing means comprises a series of rigid rails forming a pair of substantially identical rectangularly shaped reinforcing members, each of said members defining a substantially rectangularly shaped opening, said first row of tubes being attached to one corresponding side of each of said members and said second row of tubes being attached to corresponding sides of said members which are adjacent said one corresponding side, said members being parallel, spaced apart and lying in a pair of planes which are perpendicular to the longitudinal axes of said first and said second row of tubes.

4. The organizer of claim 1 further comprising golf ball dispensing means attached to one of said rows of tubes on an opposite side of said one row from said reinforcing means.

5. The Organizer of claim 1 wherein the angle between said first and said second row is approximately ninety degrees.

6. The organizer of claim 1 wherein said first plurality is five and said second plurality is five.

7. The Organizer of claim 1 comprising first putter holding means attached to one of said rows of tubes on the same side of said one row as said reinforcing means is disposed.

8. The organizer of claim 1 further comprising umbrella holding means attached to said reinforcing means.

9. The organizer of claim 1 further comprising second putter holding means attached to said reinforcing means.

10. The organizer of claim 1 further comprising first putter holding means attached to one of said rows of tubes on an opposite side of said one row from said reinforcing means, said first putter holding means being adapted to hold the shaft of an umbrella therein when said umbrella is in an open, operative state such that said open umbrella covers said organizer, and second putter holding means attached to said reinforcing means for holding a putter when said first putter holding means holds the shaft of an umbrella therein.

11. The Organizer of claim 1 wherein said plurality of sides is at least three.

12. The Organizer of claim 1 wherein said plurality of sides is four.

* * * * *

UNITED STATES PATENT AND TRADEMARK OFFICE

CERTIFICATE OF CORRECTION

PATENT NO. : 5,573,122

DATED : Nov. 12, 1996

INVENTOR(S) : Ron Williams, 506 E. Happy Valley St., Cave City, Ky. 42127

It is certified that error appears in the above-indentified patent and that said Letters Patent is hereby corrected as shown below:

on the title page, Item [73] Assignee should read -- Robert B. Hensley, part interest --.

Signed and Sealed this

Twenty-ninth Day of April, 1997

Bruce Lehman

*Attest:*

BRUCE LEHMAN

*Attesting Officer*

*Commissioner of Patents and Trademarks*